US012396477B2

(12) United States Patent
Hu et al.

(10) Patent No.: US 12,396,477 B2
(45) Date of Patent: Aug. 26, 2025

(54) PEELABLE TOBACCO AND METHOD OF USING THE SAME

(71) Applicant: SHENZHEN INNOKIN TECHNOLOGY CO., LTD., Shenzhen (CN)

(72) Inventors: Tingdong Hu, Shenzhen (CN); Jianwei Li, Shenzhen (CN)

(73) Assignee: SHENZHEN INNOKIN TECHNOLOGY CO., LTD., Shenzhen (CN)

( * ) Notice: Subject to any disclaimer, the term of this patent is extended or adjusted under 35 U.S.C. 154(b) by 392 days.

(21) Appl. No.: 18/079,980

(22) Filed: Dec. 13, 2022

(65) Prior Publication Data

US 2023/0113568 A1 Apr. 13, 2023

Related U.S. Application Data

(63) Continuation of application No. PCT/CN2021/105185, filed on Jul. 8, 2021.

(30) Foreign Application Priority Data

Jul. 8, 2020 (CN) ..... 202010649828.5
Jul. 8, 2020 (CN) ..... 202021321225.4

(51) Int. Cl.

| | |
|---|---|
| ***A24D 1/02*** | (2006.01) |
| ***A24D 1/00*** | (2020.01) |
| ***A24D 1/04*** | (2006.01) |
| ***A24D 1/20*** | (2020.01) |

(Continued)

(52) U.S. Cl.

CPC ..... *A24D 1/02* (2013.01); *A24D 1/002* (2013.01); *A24D 1/045* (2013.01); *A24D 1/20* (2020.01); *A24D 3/17* (2020.01); *A24F 40/20* (2020.01)

(58) Field of Classification Search

None

See application file for complete search history.

(56) References Cited

U.S. PATENT DOCUMENTS 9,936,727 B2 * 4/2018 Polloni ..... A24D 1/02

FOREIGN PATENT DOCUMENTS

| | | | |
|---|---|---|---|
| CN | 108433197 | A | 8/2018 |
| CN | 108851218 | A | 11/2018 |
| CN | 111657542 | A | 9/2020 |

(Continued)

OTHER PUBLICATIONS

International Search Report issued in corresponding international application No. PCT/CN2021/105185, dated Sep. 29, 2021, 12 pages.

*Primary Examiner* — Dennis R Cordray
(74) *Attorney, Agent, or Firm* — BAYES PLLC

(57) ABSTRACT

A peelable tobacco includes: an aroma volatilizing area (11), which is configured to volatilize aroma when being heated, wherein the aroma volatilizing area (11) is wrapped with a first packaging paper (1); a filter area (21), which is disposed at an upper portion of the aroma volatilizing area (11), wherein the filter area (21) is wrapped with a second packaging paper (2); and a connecting pre-breakable paper (3), which is connected to an upper portion of the first packaging paper (1) and to a lower portion of the second packaging paper (2), wherein the connecting pre-breakable paper (3) is able to be broken when suffering an external force.

8 Claims, 9 Drawing Sheets

(51) Int. Cl.
*A24D 3/17* (2020.01)
*A24F 40/20* (2020.01)

(56) References Cited

FOREIGN PATENT DOCUMENTS

| | | | |
|---|---|---|---|
| CN | 212382094 | U | 1/2021 |
| WO | 2008146543 | A1 | 12/2008 |

* cited by examiner

PEELABLE TOBACCO AND METHOD OF USING THE SAME

CROSS-REFERENCE TO RELATED APPLICATION

This application is a continuation of International Application No. PCT/CN2021/105185, filed Jul. 8, 2021, and also claims the benefit of priority to Chinese Patent Application No. 202010649828.5 and No. 202021321225.4, both filed on Jul. 8, 2020, all of which are incorporated herein by reference in their entireties.

TECHNICAL FIELD

The application relates to a peelable tobacco and a method of using the peelable tobacco.

BACKGROUND

At present, a commonly used cigarette includes tobacco, roll paper, and a filter cotton. The roll paper rolls the tobacco into a cylindrical shape, and the filter cotton (filter tip) is disposed at the end of the tobacco. Such kind of tobacco generally has a cylindrical shape. When in use, the cigarette is lit and burnt, and the smoke in the cigarette is heated and volatilized. People can inhale the smoke from the cigarette through the filter tip. When the cigarette burns, many harmful substances are produced. And with the rising of the burning temperature, it becomes more difficult to predict the kinds of harmful substances produced. A great threat will be posed to human health if these kinds of harmful substances are inhaled by human body.

At present, there is also a smoking set that can be heated without burning, which is very popular among smokers. The smoking set mainly includes a power supply, a control area and a heating area. A heating cavity (external heating mode) is formed in the heating area, and the heating cavity is generally surrounded by a plurality of heating rods (or a plurality of resistive heating wires are disposed on the periphery of the heating cavity). The heating rods are connected to the control area, the power supply is connected to the control area, and the cigarette is placed in the heating cavity. The cigarette includes tobacco and cigarette paper. A filter rod is disposed at one end of the tobacco, and the cigarette paper wraps the tobacco and the filter rod. When in use, the cylindrical cigarette is placed in the heating cavity, the tobacco and the cigarette paper are disposed in the heating cavity, and the filter rod is disposed outside the heating cavity. After the power supply is turned on, the heating wire is energized to generate heat, and the heat generated by the heating wire is transferred to the heating cavity. When the cigarette in the heating cavity is heated, the smoke in the cigarette evaporates, and people can inhale the smoke in the cigarette through the filter rod (filter tip). Such kind of cigarette that can be heated without burning has big defects. Since heating is performed at the outer edge of the cigarette, the heat generated by the heating cavity is transferred inwards through the outer edge of the cigarette, which is first transferred to the cigarette paper, and then slowly transferred to the tobacco.

In the heating and transferring process of the above-mentioned cigarette paper, the heat is transferred through the cigarette paper. The cigarette paper is a poor thermal conductor, that is, the cigarette paper has very poor thermal conductivity, so it is very difficult to quickly transfer the heat generated by the heating rod to the tobacco, resulting in slow heating speed of the tobacco.

Moreover, because the temperature of the heating rod is very high in the heating process, the heat generated by the heating rod will first gather at the cigarette paper if the heating rod is heated for a long time, so the heating rod is easy to burn the cigarette paper, and the burnt cigarette paper will produce a burnt smell and other peculiar smells, which seriously affects the taste of the tobacco.

Therefore, it is necessary to design a kind of tobacco to solve the above-mentioned problems.

SUMMARY

The application aims to overcome the defects of the prior art and to provide a peelable tobacco which has the characteristics of fast heating rate, fast heat transferring, pure taste, and no odor.

A peelable tobacco is provided, including:

an aroma volatilizing area, which is configured to volatilize aroma when being heated, wherein the aroma volatilizing area is wrapped with a first packaging paper;

a filter area, which is disposed at an upper portion of the aroma volatilizing area, wherein the filter area is wrapped with a second packaging paper; and a connecting pre-breakable paper, which is connected to an upper portion of the first packaging paper and to a lower portion of the second packaging paper, wherein the connecting pre-breakable paper is able to be broken when suffering an external force.

The aroma volatilizing area has a diameter decreasing downwards in a vertical direction.

The first packaging paper includes an operating portion extending downwards from the first packaging paper and protruding out of a lower surface of the aroma volatilizing area.

The connecting pre-breakable paper is provided with at least one pre-breakable line, and the connecting pre-breakable paper is able to be split to two parts after suffering an external force.

A method of using the peelable tobacco is provided, including:

providing a smoking set including a smoking pipe, and taking out the smoking pipe;

loading the peelable tobacco into the smoking pipe with an upper portion of the second packaging paper being exposed out of an upper portion of the smoking pipe and a lower portion of the first packaging paper being exposed out of a bottom portion of the smoking pipe;

pulling the lower portion of the first packaging paper to break the connecting pre-breakable paper by an external force, continuing to pull the first packaging paper downwards so that the pre-breakable paper is completely broken at a breaking line, and continuing to pull the first packaging paper downwards so that the connecting pre-breakable paper broken partially is driven to move downwards by the first packaging paper to separate the first packaging paper from a surface of the aroma volatilizing area and completely expose the aroma volatilizing area.

The smoking pipe is hollow, and has a diameter decreasing downwards in a vertical direction.

A peelable tobacco is provided, including:

an aroma volatilizing area, which is configured to volatilize aroma when being heated, wherein the aroma volatilizing area is wrapped with a first packaging paper, the first packaging paper is provided with a first pre-breakable area in a vertical direction, the first pre-breakable area is able to be broken when suffering an external force, and a protruding portion is arranged at a bottom portion of the first packaging paper, so that the protruding portion is operated to separate the first packaging paper from the aroma volatilizing area; and a filter area, which is disposed at an upper portion of the aroma volatilizing area, wherein the filter area is wrapped with a second packaging paper, and a lower portion of the second packaging paper is connected to an upper portion of the first packaging paper.

A peelable tobacco is provided, including:

an aroma volatilizing area, which is configured to volatilize aroma when being heated, wherein the aroma volatilizing area is wrapped with a first packaging paper, the first packaging paper is provided with a first pre-breakable area, the first pre-breakable area is in a spiral shape from top to bottom and is able to be broken when suffering an external force, and a protruding portion is arranged at a bottom of the first packaging paper, so that the protruding portion is operated to separate the first packaging paper from the aroma volatilizing area; and a filter area, which is disposed at an upper portion of the aroma volatilizing area, wherein the filter area is wrapped with a second packaging paper, and a lower portion of the second packaging paper is connected to an upper portion of the first packaging paper.

The connecting pre-breakable paper provided by the present application wraps the upper portion of the first packaging paper and the lower portion of the second packaging paper and is able to be broken when suffering the external force. By pulling the first packaging paper with the external force, the connecting pre-breakable paper partially broken is driven to move downwards by the first packaging paper, so that the first packaging paper is separated from the surface of the aroma volatilizing area, and the aroma volatilizing area is completely exposed. The aroma volatilizing area is heated, and the heat is transferred inwards from the periphery of the heating cavity. Since no cigarette paper exists in the heating cavity and the aroma volatilizing area, the heat is directly transferred to the aroma volatilizing area, achieving rapid thermal conduction and fast heating. Moreover, in the heating process, only the aroma volatilizing area is heated, which excludes burning of the cigarette paper; therefore, the aroma/smoke produced after the aroma volatilizing area of the cigarette is heated is pure in taste, and the burnt smell of the cigarette paper is not mixed. Moreover, in the heating process, the temperature can be directly raised to the temperature at which the aroma is volatilized, so there is no need to worry about burning the cigarette paper, and the temperature limit of the cigarette paper can be eliminated, that is, the maximum temperature limit of the cigarette paper can be avoided, and the aroma volatilization area can be directly heated.

Further, the application provides a method of using the peelable tobacco. The peelable tobacco is placed in the smoking pipe of the smoking set, the first packaging paper is separated from the surface of the aroma volatilizing area by the external force to make the aroma volatilizing area completely exposed, and then the aroma volatilizing area is heated. The operation is convenient, rapid, simple and practical.

BRIEF DESCRIPTION OF DRAWINGS

In order to better illustrate embodiments of the present application or technical solution, the accompanying drawings to be used in the embodiments will be briefly described below. Obviously, the drawings in the following description are only a part of embodiments described in the present application, and a person of ordinary skill in the art may also obtain other drawings based on these drawings without creative effort.

DETAILED DESCRIPTION

Figure 1:
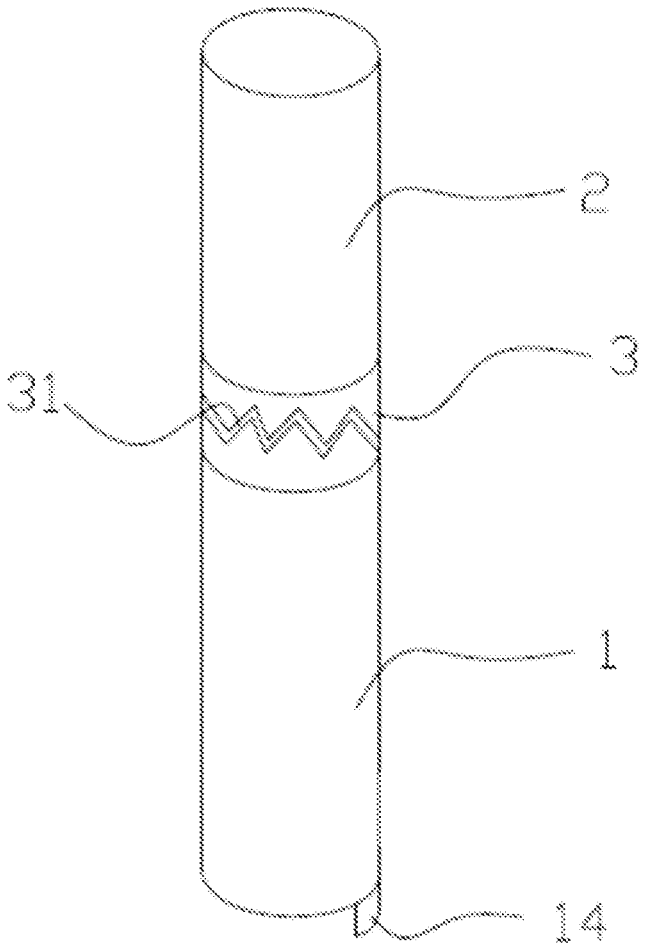
FIG. 1 is a three-dimensional view of a first embodiment of a peelable tobacco provided according to embodiments of the present application.
Figure 2:
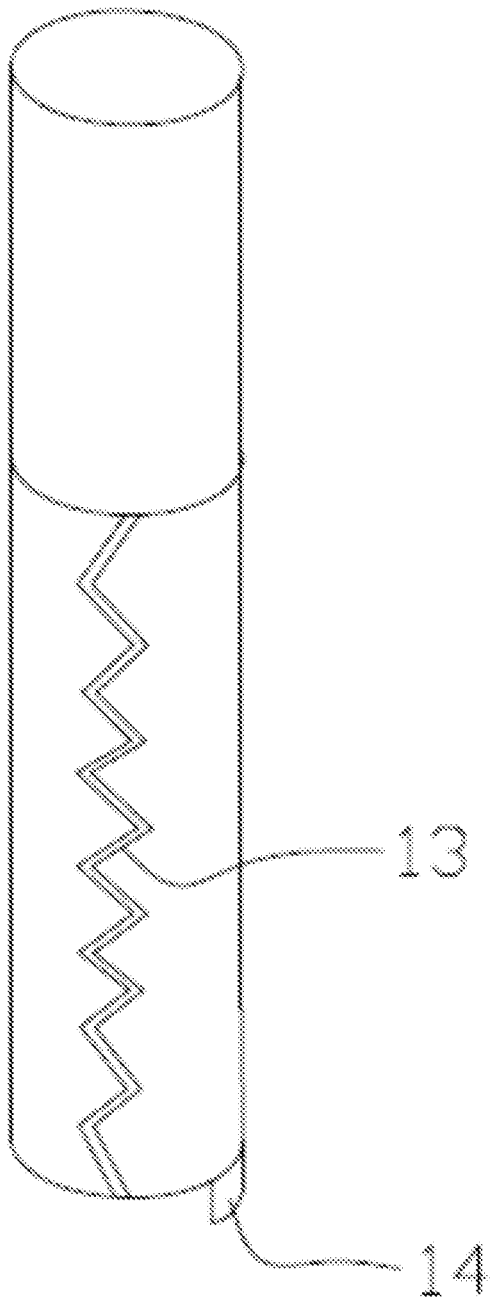
FIG. 2 is a three-dimensional view of a second embodiment of the peelable tobacco provided according to embodiments of the present application.
Figure 3:
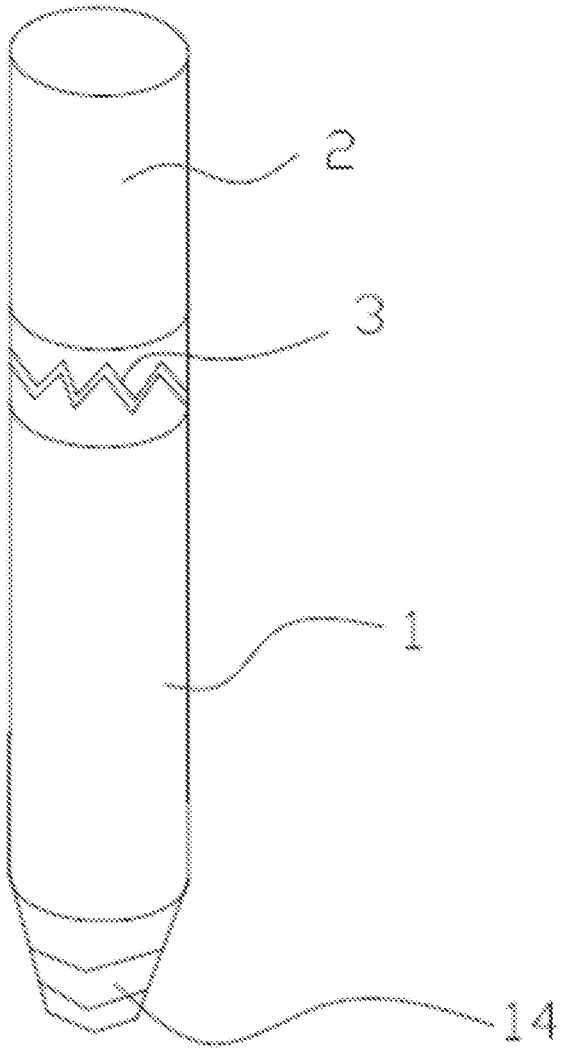
FIG. 3 is a three-dimensional view of a third embodiment of the peelable tobacco provided according to embodiments of the present application.

The technical solutions in the embodiments of the present application will be described as below with reference to the accompanying drawings in the embodiments of the present application. Obviously, the described embodiments are only a part of, not all of, the embodiments of the present application. All other embodiments obtained by a person of ordinary skill in the art based on the embodiments of the present application without creative effort shall fall into the protection scope of the present application.

As shown in FIG. 1 to FIG. 9, embodiments of the present application provide a peelable tobacco. The peelable tobacco includes an aroma volatilizing area 11, which is configured to volatilize aroma when being heated, wherein the aroma volatilizing area 11 is wrapped with a first packaging paper 1; a filter area 21, which is disposed at an upper portion of the aroma volatilizing area 11, wherein the filter area 21 is wrapped with a second packaging paper 2; and a connecting pre-breakable paper 3, which is connected to an upper portion of the first packaging paper 1 and a lower portion of the second packaging paper 2 and is able to be broken when suffering an external force. The connecting pre-breakable paper 3 may partially wrap the aroma volatilizing area 11 and the filter area 21, and may also wrap one or both of the first packaging paper 1 or the second packaging paper 2. In this specification, the peelable tobacco designed is illustrated by taking the cylindrical shape as an example, which has the same shape as ordinary cigarettes. In other embodiments, the peelable tobacco may also be of a square shape, a polygonal shape, or the like. The aroma volatilizing area 11 may be a mixture of tobacco and flavorant, and may also be a purified product of the tobacco, an extract of the flavorant, or the like. The filter area 21 is mainly used for filtering impurities in smoke, and can be a filter cotton, a filter rod, a fiber filter material, or the like. The first packaging paper 1 and the second packaging paper 2 are also known as cigarette paper, which is a kind of thin paper specially used for packaging tobacco to make cigarettes. The cigarette paper is a kind of rolled paper-based material with a celluloid fiber material and a pattern of additive materials. The cigarette paper is disc-shaped, is divided into vertical embossed cigarette paper, horizontal embossed cigarette paper, and anti-counterfeiting cigarette paper, and is a kind of thin special paper used to wrap tobacco. The first packaging paper 1, the second packaging paper 2. and the connecting pre-breakable paper 3 may be made of the same material or different materials.

The connecting pre-breakable paper 3 may also be made of cigarette paper. The connecting pre-breakable paper 3 is provided with at least one pre-breakable line 31 and is split into two parts after the pre-breakable line 31 suffers an external force. The pre-breakable line 31 is horizontal and has a certain amplitude (such as a zigzag shape) in a vertical direction, or the pre-breakable line 31 is horizontally disposed and may be one, two, or more. After suffering the external force, the pre-breakable line 31 is split along the line direction and is cracked in the horizontal direction, which makes the connecting pre-breakable paper 3 to be split into two parts along the pre-breakable line 31.

The diameter of the aroma volatilizing area 11 decreases downwards along the vertical direction and is in a conical shape, which is large in upper portion and small in lower portion. The diameter of the upper portion may also be large, and the diameter of the lower portion is slightly small. In this case, it is unnecessary to be a conical shape, and the aroma volatilizing area 11 may also be of a trapezoid shape from the section in the vertical direction. Such design, that is, large in upper portion and small in lower portion, is convenient to operate, and the first packaging paper 1 is convenient to withdraw out of the aroma volatilizing area 11. In some embodiments, the diameter of the aroma volatilizing area 11 may also be equal. With the design of equal diameter, great resistance may be caused when the first packaging paper 1 is separated from the aroma volatilizing area 11, while separation can also be performed successfully.

An operating portion 14 extends downwards from the first packaging paper 1 and protrudes out of a lower surface of the aroma volatilizing area 11. The operating portion 14 can be designed as a protruding paper end, which is conveniently clamped by a human hand. Mechanical clamping is facilitated during mechanical operation. By clamping the operating portion 14 with the human hand and pulling downwards with a force, the first packaging paper 1 is driven to move downwards by the operating portion 14 so as to break/pull off the pre-breakable line 31. By continuing to pull with a force, the first packaging paper 1 continues to move downwards so that the first packaging paper 1 is further separated from the outer surface or side surface of the aroma volatilizing area 11.

A method of using a peelable tobacco is provided, which includes the following steps.

A smoking set including a smoking pipe 4 is provided, and the smoking pipe 4 is taken out. The smoking set is also known as a heating device without burning and is mainly used for heating tobacco. The heating may include internal heating, external heating, or a mixture of internal heating and external heating.

The peelable tobacco is loaded into the smoking pipe 4 with an upper portion of a second packaging paper 2 exposed out of an upper portion of the smoking pipe 4, and a lower portion of a first packaging paper 1 exposed out of a bottom portion of the smoking pipe 4. The operating portion 14 is exposed out of a lower surface of the smoking pipe 4 and protrudes out of the lower surface of the smoking pipe 4, so as to be conveniently held by a human hand. The operating portion 14 may be a cigarette paper reserved during processing.

The lower portion of the first packaging paper 1 is pulled with a force, so that a connecting pre-breakable paper 3 suffers the external force and is broken. The first packaging paper 1 continues to be pulled downwards, and the broken part is completely broken. The first packaging paper 1 continues to be further pulled downwards, and brings the connecting pre-breakable paper 3, which is now partially broken, to move downwards together, so that the first packaging paper 1 is separated from a surface of the aroma volatilizing area 11 and the aroma volatilizing area 11 is completely exposed.

The smoking pipe 4 is hollow, and the diameter of the smoking pipe 4 decreases downwards in the vertical direction. With the design that the diameter of the aroma volatilizing area 11 decreases downwards in the vertical direction or the design that the diameter of the aroma volatilizing area 11 is equal, the cigarette is convenient to load and take out.

A peelable tobacco includes an aroma volatilizing area 11, which is configured to volatilize aroma when being heated, wherein the aroma volatilizing area 11 is wrapped with a first packaging paper 1, the first packaging paper 1 is provided with a first pre-breakable portion 13 in a vertical direction, the first pre-breakable portion 13 is able to be broken when suffering an external force, a protruding portion is disposed at a bottom of the first packaging paper 1, so that the protruding portion is operated to separate the first packaging paper 1 from the aroma volatilizing area 11; and a filter area 21, which is disposed at an upper portion of the aroma volatilizing area 11, wherein the filter area 21 is wrapped with a second packaging paper 2, and a lower portion of the second packaging paper 2 is connected to an upper portion of the first packaging paper 1. The first pre-breakable paper which is designed vertically is also convenient for pulling the cigarette paper by hand, so that the aroma volatilizing area is exposed. With such a design, the protruding portion disposed at the bottom of the first packaging paper 1 can be directly pulled out, the first packaging paper is unfolded to a plane after being broken along the first pre-breakable portion 13, and the aroma volatilizing area 11 is completely exposed.

Figure 4:
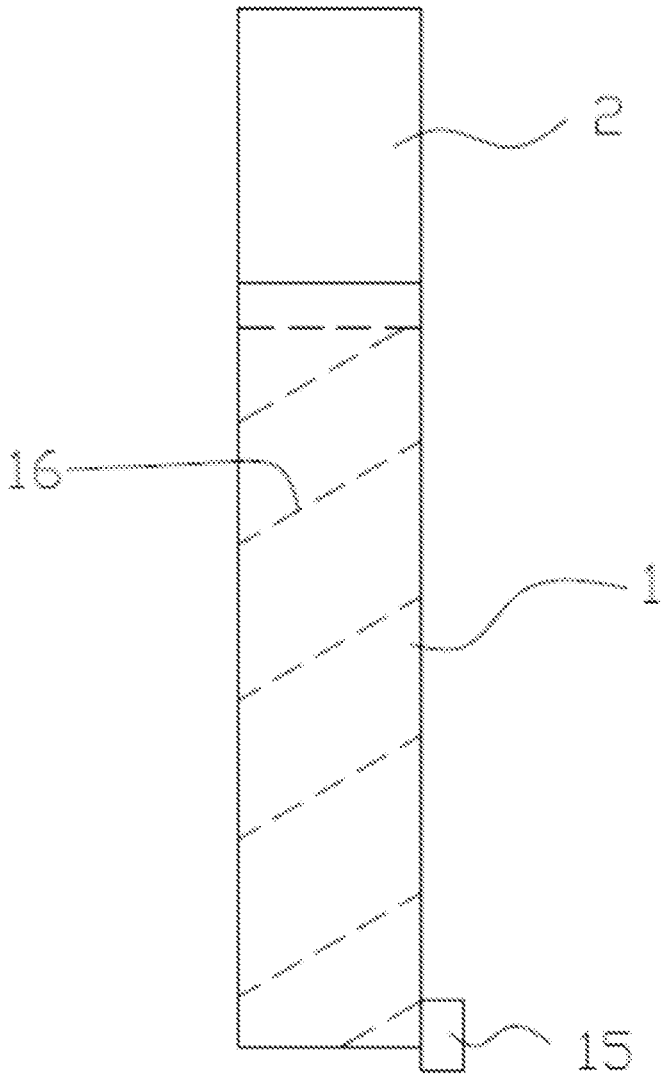
FIG. 4 is a three-dimensional view of a fourth example of the peelable tobacco provided according to embodiments of the present application.
Figure 5:
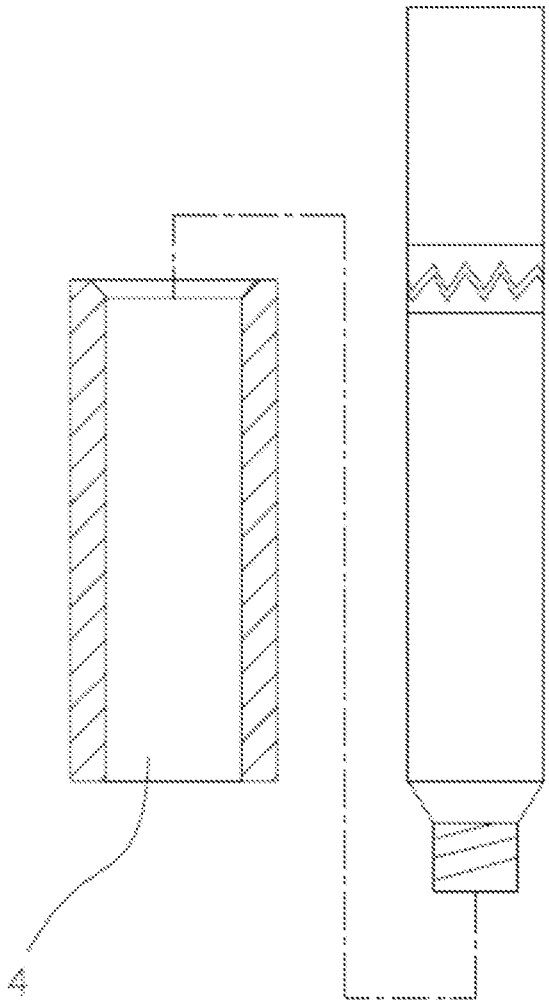
FIG. 5 is a schematic diagram of a smoking pipe of the peelable tobacco provided according to embodiments of the present application.
Figure 6:
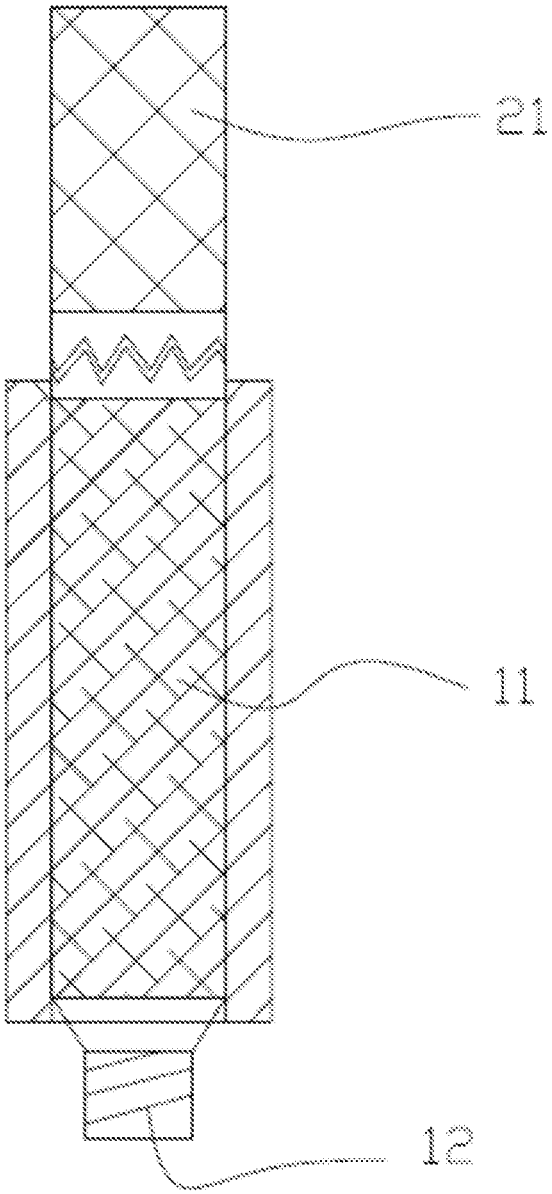
FIG. 6 is a sectional view of the peelable tobacco loaded into the smoking pipe, provided according to embodiments of the present application.
Figure 7:
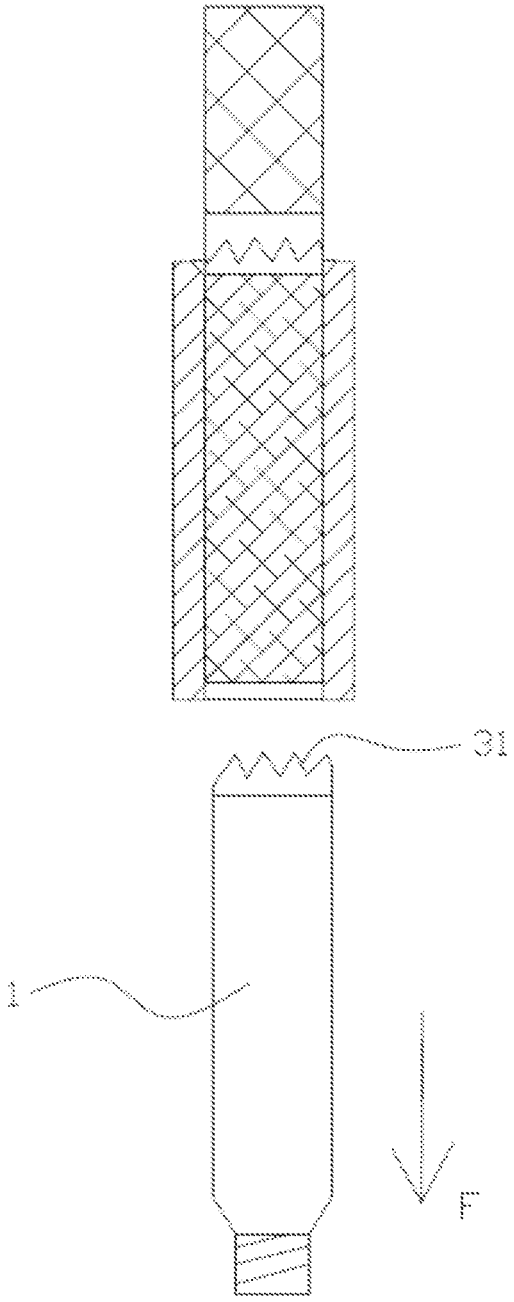
FIG. 7 is a sectional view of a first packaging paper pulled out of the smoking pipe by an external force, provided according to embodiments of the present application.
Figure 8:
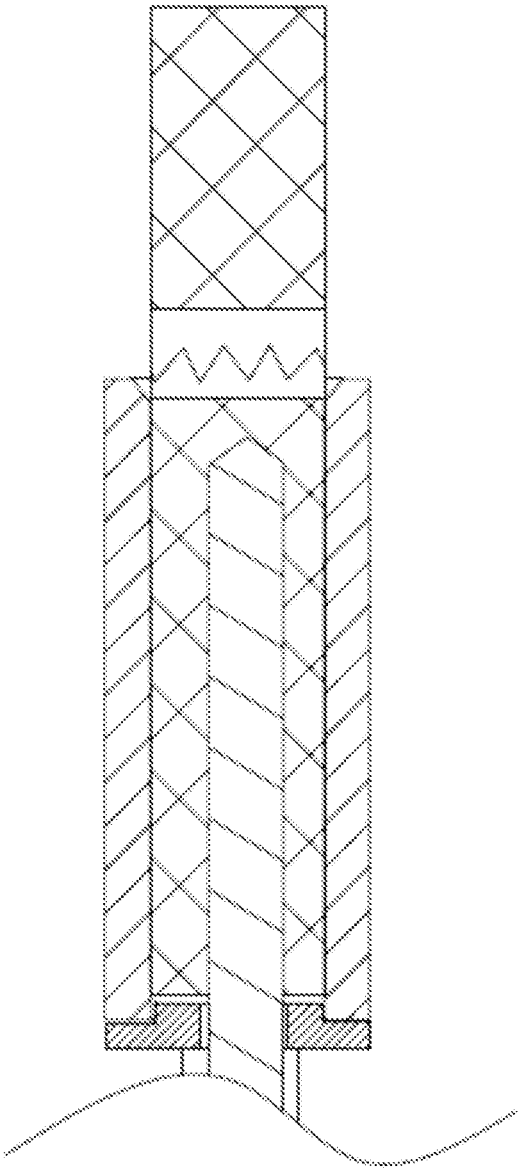
FIG. 8 is a sectional view during heating, provided according to embodiments of the present application.
Figure 9:
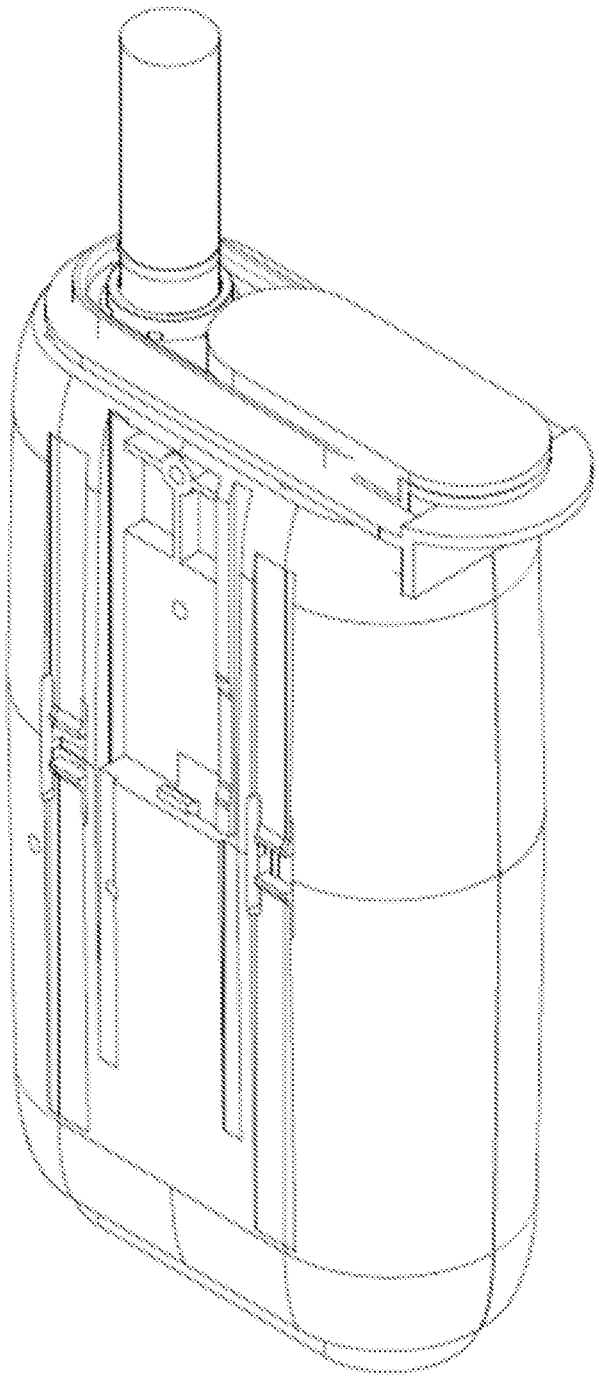
FIG. 9 is a schematic view of a smoking set provided according to embodiments of the present application.

Referring to another design shown in FIG. 4, a peelable tobacco includes an aroma volatilizing area 11, which is configured to volatilize aroma when being heated, wherein the aroma volatilizing area 11 is wrapped with a first packaging paper 1. The first packaging paper 1 is provided with a first pre-breakable portion 16, the first pre-breakable portion 16 is in a spiral shape from top to bottom and is able to be broken when suffering an external force, and a protruding portion 15 is disposed at a bottom of the first packaging paper 1, so that the protruding portion 15 is operated to separate the first packaging paper 1 from the aroma volatilizing area 11 by pulling the operating portion 14, the first packaging paper 1 is split in a spiral shape along the first pre-breakable portion 14, and the first pre-breakable portion 14 can also be exposed. The peelable tobacco also includes a filter area 21, which is disposed at an upper portion of the aroma volatilizing area 11, wherein the filter area 21 is wrapped with a second packaging paper 2, and a lower portion of the second packaging paper 2 is connected to an upper portion of the first packaging paper 1. The principle is similar to that mentioned above and will not be elaborated. The difference lies in that the first packaging paper is unfolded in a spiral shape along the first pre-breakable portion when the operating portion is pulled, which is manifested in horizontal and vertical action, and is not limited to such tearing and splitting. If mechanical operation is adopted, the protruding portion can be fixed or clamped, and then the peelable tobacco is rotated. The first packaging paper is torn along the first pre-breakable line, and the first packaging paper which is torn is in a long strip shape, so that the aroma volatilizing area is exposed.

The above only describes exemplary embodiments of the present application and is not intended to limit the application. Any modification, equivalent substitution, improvement, etc. made within the gist and principles of the present application shall fall within the protection scope of the present application.

What is claimed is:

1. A peelable tobacco, comprising:

an aroma volatilizing area, which is configured to volatilize aroma when being heated, wherein the aroma volatilizing area is wrapped with a first packaging paper;

a filter area, which is disposed at an upper portion of the aroma volatilizing area, wherein the filter area is wrapped with a second packaging paper; and a connecting pre-breakable paper, which is connected to an upper portion of the first packaging paper and to a lower portion of the second packaging paper, wherein the connecting pre-breakable paper is able to be broken when suffering an external force, wherein the first packaging paper comprises an operating portion extending downwards and protruding out of a lower surface of the aroma volatilizing area.

2. The peelable tobacco of claim 1, wherein the aroma volatilizing area has a circular cross-section with a diameter decreasing downwards in a vertical direction.

3. The peelable tobacco of claim 1, wherein the connecting pre-breakable paper is provided with at least one pre-breakable line, and the connecting pre-breakable paper is able to be split into two parts after suffering an external force.

4. A method of using the peelable tobacco of claim 1, comprising:

providing a smoking set comprising a smoking pipe, and taking out the smoking pipe;

loading the peelable tobacco into the smoking pipe with an upper portion of the second packaging paper being exposed out of an upper portion of the smoking pipe and a lower portion of the first packaging paper being exposed out of a bottom portion of the smoking pipe; and pulling the lower portion of the first packaging paper to break the connecting pre-breakable paper by an external force, continuing to pull the first packaging paper downwards so that the connecting pre-breakable paper is completely broken at a breaking line, and continuing to pull the first packaging paper downwards so that the first packaging paper is separated from a surface of the aroma volatilizing area to completely expose the aroma volatilizing area.

5. The method of using the peelable tobacco of claim 4, wherein the smoking pipe is hollow, and has a circular cross-section with a diameter decreasing downwards in a vertical direction.

6. A peelable tobacco, comprising:

an aroma volatilizing area, which is configured to volatilize aroma when being heated, wherein the aroma volatilizing area is wrapped with a first packaging paper, the first packaging paper is provided with a first pre-breakable area, the first pre-breakable area is able to be broken when suffering an external force, and a protruding portion is arranged at a bottom portion of the first packaging paper, so that the protruding portion is operated to separate the first packaging paper from the aroma volatilizing area; and a filter area, which is disposed at an upper portion of the aroma volatilizing area, wherein the filter area is wrapped with a second packaging paper, and a lower portion of the second packaging paper is connected to an upper portion of the first packaging paper, wherein the protruding portion extends downwards and protrudes beyond the bottom portion of the aroma volatilizing area.

7. The peelable tobacco of claim 6, wherein the first pre-breakable area is in a vertical direction.

8. The peelable tobacco of claim 6, wherein the first pre-breakable area is in a spiral shape from top to bottom.

* * * * *